United States Patent [19]

Marchand

[11] Patent Number: 5,074,499

[45] Date of Patent: Dec. 24, 1991

[54] SYSTEM FOR TRANSMITTING INITIALIZATION INFORMATION BETWEEN FIXED INSTALLATIONS AND TRAINS

[75] Inventor: Patrick Marchand, Plessis-Bouchard, France

[73] Assignee: GEC Alsthom SA, Paris, France

[21] Appl. No.: 437,568

[22] Filed: Nov. 17, 1989

[30] Foreign Application Priority Data

Nov. 18, 1988 [FR] France ..... 88 15006

[51] Int. Cl.[5] ..... B61L 3/12

[52] U.S. Cl. ..... 246/182 R; 246/167 R; 246/187 B

[58] Field of Search ..... 246/167 R, 182 R, 187 R, 246/34 R, 3, 4, 187 B

[56] References Cited

U.S. PATENT DOCUMENTS

| | | | |
|---|---|---|---|
| 3,676,669 | 7/1972 | Jauquet | 246/182 R |
| 3,700.886 | 10/1972 | Birkin | 246/167 R X |
| 3,963,201 | 6/1976 | Brumberger et al. | 246/34 R |
| 3,966,148 | 6/1976 | Sahasrabudhe | 246/34 R |
| 3,992,698 | 11/1976 | Sahasrabudhe et al. | 246/187 B X |
| 4,026,506 | 5/1977 | Bourke et al. | 246/187 B X |
| 4,029,274 | 6/1977 | Sibley | 246/187 B |
| 4,081,160 | 3/1978 | Devy et al. | 246/167 R X |
| 4,087,067 | 5/1978 | Bahker et al. | 246/167 R |
| 4,166,514 | 9/1979 | de Fréminville et al. | 246/182 R X |
| 4,314,237 | 2/1982 | Darrow | 246/182 R X |
| 4,349,170 | 9/1982 | Bilet et al. | 246/182 R X |
| 4,442,988 | 4/1984 | Laurent et al. | 246/167 R X |
| 4,742,460 | 5/1988 | Hollands | 246/167 R X |

FOREIGN PATENT DOCUMENTS

| | | |
|---|---|---|
| 0233017 | 8/1987 | European Pat. Off. . |
| 2068930 | 9/1971 | France . |

*Primary Examiner*—Frank E. Werner
*Assistant Examiner*—Scott L. Lowe
*Attorney, Agent, or Firm*—Sughrue, Mion, Zinn, Macpeak & Seas

[57] ABSTRACT

A system for transmitting initialization information between fixed installations and trains. The system comprises: an initialization loop (bi) physically constituted in the same way as a speed monitoring loop; a speed monitoring coil (cd) which is also used for receiving initialization messages; a source of initialization messages (si) connected to the initialization loop and providing a message in the form of an initialization carrier wave having an initialization frequency modulated by frequency shift keying, with the level of the wave being considerably higher than the level of the carrier wave for speed monitoring; and circuits (di) for detecting initialization information, the circuits being connected to the speed monitoring coil and detecting the frequency shift keying in order to provide a received initialization message under the control of a switching device (ad, dp, sd, ri) which responds to reception of the initialization frequency solely when the frequency is at a level which exceeds a predetermined threshold.

7 Claims, 1 Drawing Sheet

SYSTEM FOR TRANSMITTING INITIALIZATION INFORMATION BETWEEN FIXED INSTALLATIONS AND TRAINS

This is a divisional of copending application Ser. No. 602,749 filed on 10-24-90, abandoned.

The present invention relates to railway signalling systems, and more particularly to systems for transmitting information between fixed installations and trains.

The subject matter of the invention is an information transmission system of this type serving for so-called "initialization" of trains.

BACKGROUND OF THE INVENTION

There exists a system for driving and/or supervising trains known under the (French) acronym SACEM for "System for Assisting in Driving, Operation, and Maintenance", which system comprises fixed installations along the track and control equipment in each train. The control equipment of any train on the railway network under SACEM control receives messages from the fixed installations describing portions of the network in "lengths" each comprising several "blocks" that the train will encounter on continuing its journey. The train driving system thus receives "invariants" relating to permanent information such as the locations of points, switches, signals, speed limits, gradients, etc., and "variants" relating to time-varying information, and in particular the current positions of points, switches, and signals. In addition, the train receives similar information from the track each time it goes past points, switches, signalling lights, and signs. By comparing the information received from these sources and integrating internal displacement data, the system is capable of locating the train relative to the network and consequently of adjusting the running of the train.

Such a system, and any similar system, naturally assumes that the control equipment of each train is initialized whenever it enters a network under SACEM control, thereby enabling the equipment, while the train is still outside the controlled network, to receive one or more messages adequately describing the length into which the train will go on entering the network so that said control equipment will be capable of running the train, and in particular of stopping it if the track is not free. Similarly, initialization is necessary if a train is reversed or uncoupled.

Such initialization must be performed under very strict safety conditions since an initialization error could cause a train to intrude dangerously onto the controlled network.

Numerous solutions have been proposed for solving the problem of transmitting messages from fixed installations to a train. For example, in the SACEM system, messages are transmitted by current induction using the rails. Security against possible falsification of a message is obtained by redundancy in the received messages. The information contained in each message is verified to determine whether the message corresponds to the environment as already established in the train control system on the basis of previously-received messages that have been accepted. A message that contradicts this environment is rejected.

On initialization, such precautions are not possible since the environment has not yet been established. In the SACEM system this has led to providing specific initialization means. These means are in the form of an initialization loop disposed between the rails at each inlet to the controlled network. This loop is fed with an alternating current and from place to place its wires cross over such that a coil mounted on a train and detecting the alternating current senses phase inversions which constitute coded information. Another loop is disposed between the rails parallel to the first and is read by a different coil and serves to provide reference information enabling the encoded information to be interpreted.

Such a system is satisfactory from the safety point of view. The signals from the two loops run no risk of being detected separately by the two initialization coils of a train running along a parallel track which could convey erroneous initialization information to that train. However, the system suffers from two constraints: specific initialization equipment needs to be mounted on each train, and a train must be moving in order to receive an initialization message.

Away from controlled networks, there also exists a system for transmitting messages from fixed installations to trains for the purpose of monitoring train speeds. At each transmission location, the system includes an elongate loop disposed on either side of a rail on the base of the rail and fed with a frequency modulated speed-monitoring carrier wave. This wave is detected by a speed-monitoring coil disposed on the train and facing the rail. In practice, two loops are disposed in parallel, one on each rail and the train carries two speed-monitoring coils, one per rail. Such a system is used merely for monitoring train speed and therefore has no direct influence on the running of the train, and as a result it does not need to offer a high degree of safety. In particular, it suffers from a danger of cross-talk, as explained below, and is therefore unsuitable for secure transmission of initialization messages.

The object of the present invention is therefore to provide an initialization system based on the second above-mentioned system but providing the required degree of security so that initialization can be performed without suffering from the constraints specified with respect to the first-mentioned system.

This provides considerable equipment saving in that the same transmission means are used for two purposes, and in operation it provides a considerable time saving since a train can be initialized while stationary, immediately prior to being authorized to move onto the controlled network.

SUMMARY OF THE INVENTION

The transmission system of the invention comprises an initialization loop physically constituted in the same way as a speed monitoring loop; a speed monitoring coil which is also used for receiving initialization messages; a source of initialization messages connected to the initialization loop and providing a message in the form of an initialization carrier wave having an initialization frequency modulated by frequency shift keying, with the level of said wave being considerably higher than the level of the carrier wave for speed monitoring; and circuits for detecting initialization information, said circuits being connected to the speed monitoring coil and detecting the frequency shift keying in order to provide a received initialization message under the control of a switching device which responds to reception of the initialization frequency solely when said frequency is at a level which exceeds a predetermined threshold.

Said switching device preferably comprises, downstream from the speed-monitoring coil, at least one linear amplifier and a detection circuit for detecting the level of the carrier wave, the detection circuit feeding a threshold circuit containing said predetermined threshold and providing a changeover signal when the level of the carrier wave exceeds the threshold.

Said amplifier may also feed two parallel-connected demodulators, one of the demodulators serving to detect the frequency modulation of an initialization message, and the other demodulator serving to detect the frequency modulation of a speed-monitoring message, with the output of only one of these demodulators being active at any given time depending on said changeover signal.

Said switching device may include a relay controlled by said changeover signal, said relay including at least one contact for activating the output of one or other of said two demodulators.

Said switching device may also control the output of a second demodulator for detecting the frequency modulation of a second speed-monitoring message that may be received via a second coil, said output being controlled in such a manner as to be rendered inactive during reception of an initialization message.

The output from said circuit for detecting the level of the carrier wave may be connected via a switch element controlled by said switching device to an intrinsically safe signalling circuit for authorizing exploitation of the initialization message as provided at the output from said demodulator that detects the frequency modulation of an initialization message.

Said demodulator for detecting the frequency modulation of an initialization message may be a circuit which evaluates the duration of periods in the received modulated carrier wave and which provides an output signal at a first level when said durations are on average greater than a predetermined duration and provides an output signal at a second level when said durations are on average less than said duration or some other predetermined duration.

BRIEF DESCRIPTION OF THE DRAWINGS

An embodiment of the invention is described with reference to the accompanying FIGURE which shows an initialization message transmission system also serving to receive speedmonitoring messages.

DETAILED DESCRIPTION

Figure 1:
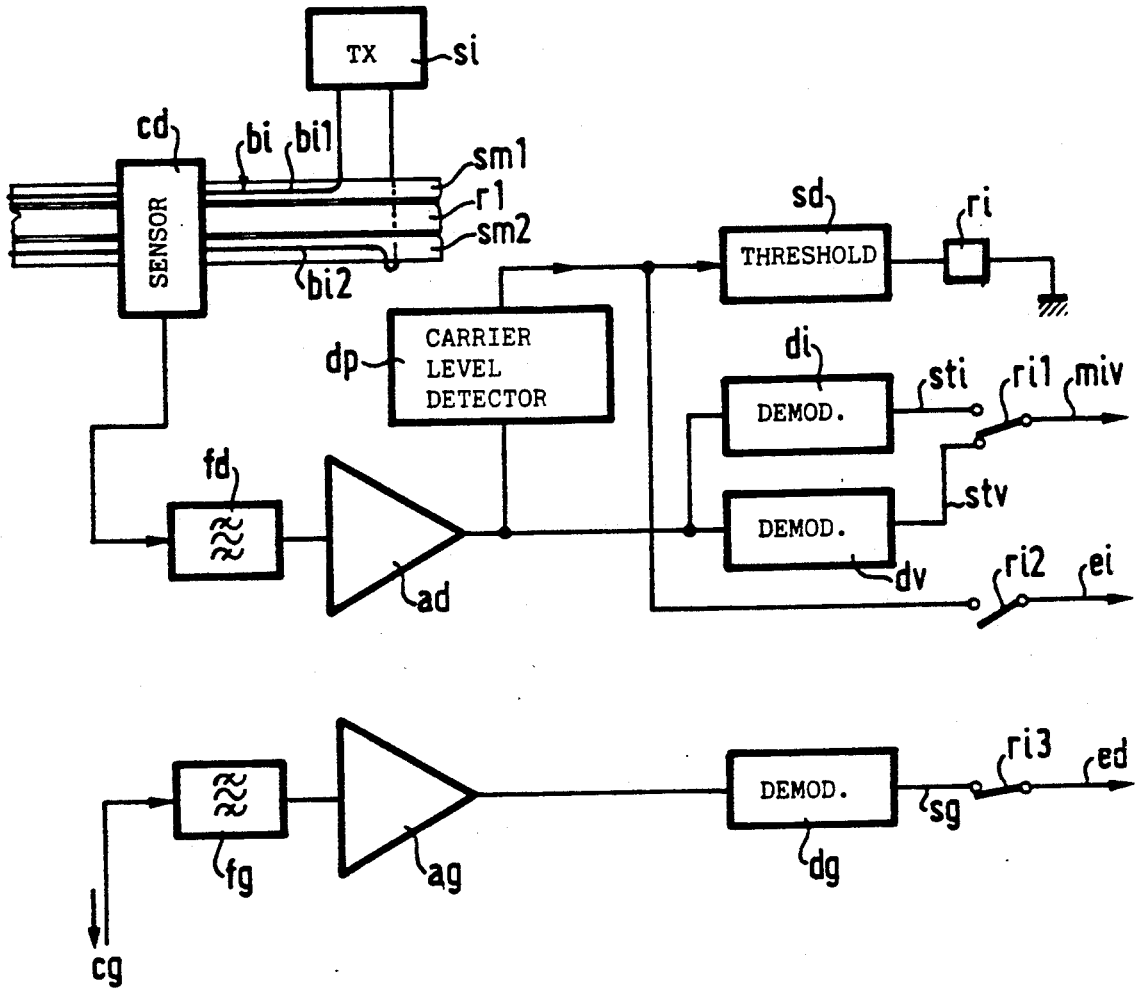

The FIGURE shows a rail r1, e.g. the righthand rail of a track, at the location on said track where an initialization loop bi is disposed. The portions bi1 and bi2 of this loop extend over the portions sm1 and sm2 of the base of the rail towards the left in the figure, and after extending over a length of several meters, they interconnect beneath the rail. To the right in the figure the conductors bi1 and bi2 are connected to a source of initialization messages si. This message source si forms a portion of the fixed installations of a system for driving and/or supervising trains of the same type as the above-mentioned SACEM system. It generates a carrier wave which is modulated by frequency shift keying and which is applied to the loop bi. The frequency of the carrier wave may be 125 kHz, for example, with the current flowing in the loop being 145 mA peak-to-peak, with the frequency shifts displacing frequency by ±10%, and with the rate at which frequency is shifted corresponding to transmission at 250 bauds. It should be underlined at this stage that the current in the loop is deliberately chosen to be considerably greater than the current that can be induced anywhere in the network for whatever reason under similar conditions.

A train to be initialized coming over the loop carries a righthand sensor cd immediately above the rail r1. This sensor includes an induction coil at whose terminals there appears a signal representative of the modulated carrier wave applied to the loop bi. The train may be stationary or moving.

The signal from the sensor is transmitted via a bandpass filter fd to an amplifier ad which is linear over the design range of levels. This amplifier must be of an intrinsically safe type, i.e. under no circumstances must it amplify a signal at its input by more than the maximum design gain. A known amplifier of this type is essentially constituted by a common collector transistor amplifier followed by a voltage-raising transformer. The amplifier provides current gain but its voltage gain is not greater than 1. The voltage amplification of the input signal is thus equal to no more than the transformer ratio of the transformer.

The amplified signal is then applied to a circuit dp for detecting the level of the carrier wave, which circuit may be a simple peak rectifier.

The level of the carrier wave is communicated to a threshold circuit sd. This circuit may be a comparator which provides a switchover signal to excite an initialization relay r1 when the level of the carrier wave exceeds a predetermined threshold. The contacts ri1, ri2, and ri3 of this relay which are shown in their rest positions, then switchover to their working positions.

The signal from the amplifier ad is also applied in parallel to two demodulators di and dv. The contact ri1 engages the output sti of the demodulator di only, with the output stv of the demodulator dv being left inactive.

For reliable transmission, the demodulator di is preferably a period demodulator, i.e. a circuit that evaluates the durations of periods (or half periods) of the received modulated carrier wave, providing an output signal at a first level when said durations are on average greater than a predetermined duration while providing an output signal at a second level when said durations are on average less than said duration or less than some other predetermined duration. The beginning of each period in the received wave may thus trigger a plurality of time constant circuits, with two of them, for example, delimiting time intervals whose ends bracket the moment at which the period is expected to end when the frequency of the carrier wave is increased by the frequency shift keying, whereas two other time constant circuits bracket the expected period end when the frequency is reduced by the frequency shift keying. Thus, a logical combination of the outputs from these circuits, together with an integration circuit, can provide an output signal having at least two states, one of the states corresponding to the higher frequency of the keying and the other state corresponding to any other frequency. It is also possible to provide a three-state output, with the states corresponding respectively to a non-modulated frequency, to the higher frequency, and to the lower frequency. The signal provided on output sti is transmitted via contact ri1 to the train control equipment via a link miv.

The signal provided by the carrier wave level detection circuit is also transmitted to the train control equipment via contact ri2 and link ei whenever said level exceeds the predetermined threshold of the circuit sd.

In this case, in order to increase safety, the transmission of the signal may include a DC-DC converter providing safety decoupling. The presence of this signal informs the control equipment that an initialization request is being made, and it is essential that this signal cannot be falsified under any circumstances, e.g. due to a component failure.

The initialization message transmitted repetitively by the source si to the loop bi is thus detected by a train which may be stopped over the loop bi, and is conveyed to the control equipment of the train. The control equipment of the train can thus be initialized.

It may be observed that open contact ri3 isolates the lefthand transmission system (described below) in order to ensure that any disturbance on this system does not interfere with the initialization process.

Since the level of the message carrier wave is higher than any other signal that may be induced along the righthand rail of the track, at any location in the network, detection by a predetermined threshold being exceeded serves to protect the system from accidental imitation of an initialization message by any other regularly induced signal. This also solves the case of unwanted transmission of a genuine initialization message to a train on a track other than that to which the message is being transmitted. The level at which the message is received by the other train is too low to exceed the threshold.

There remains the possibility of the amplifier ad oscillating. The threshold of the circuit sd will naturally be exceeded. The probability of this oscillation taking place at the frequency of the initialization is low, but because of non-linear phenomena which are always present in such cases, a conventional frequency demodulator could still provide demodulated signals that could be accepted by the control equipment. However, by using a period demodulator in this case having a response that can be narrowly centered on the two modulation frequencies, it is possible to greatly reduce the risk in practice of an erroneous response of the initialization system.

There follows an explanation of how the same equipment can be used for receiving speed monitoring messages and how there is no danger of these messages being mistaken for initialization messages. It is assumed that the train is over a speed monitoring loop occupying the position of the loop bi in the figure.

A loop for transmitting speed monitoring messages is similar to the loop bi. However the signals transmitted over said loop are at a lower level than the level for initialization signals. The frequency of these signals is the same as the frequency of initialization signals. Modulation conditions are different. The modulation rate, in particular, is higher.

Such signals pass through the filter fd and the amplifier ad. The level detected by the circuit dp is too low to reach the threshold included in the circuit sd. Consequently, the relay ri remains at rest and its contacts occupy the positions shown in the figure. No signal is provided to the link ei. The received message cannot therefore be interpreted as an initialization message. The frequency demodulator dv is of conventional type and receives the signal present at the output from the amplifier ad, as does the demodulator di. The demodulator dv demodulates the message and provides the demodulated message on its output stv. Since the contact ri1 is at rest, this output is active and the speed monitoring message is transmitted to the train controlling equipment over the link miv. During this time, the output from the demodulator di is inactive. There is thus no risk of the received message being taken to be an initialization message.

It is important to emphasize that all of the components contributing to receiving this message also serve for receiving initialization messages, thereby providing a significant saving in equipment.

In parallel, since the other rail of the track is equipped with a similar loop, a lefthand sensor cg (not shown) feeds a lefthand bandpass filter fg, an amplifier ag and demodulator dg, whose output is coupled via link sg and contact ri3 to a link ed, thereby constituting a lefthand reception system similar to the above-described righthand system, thus enabling a second speed monitoring message to be transmitted to the train controlling equipment.

It may be observed that if a track fitted with an initialization loop is taken in the reverse direction by a train, it is the lefthand system of the train which receives the signal from the loop bi. However, the righthand system does not receive a signal suitable for exciting the relay ri. Its contact ri2 therefore remain open and the control equipment cannot accept an initialization message. The link miv therefore receives no message, and the message received by the left system is ignored.

I claim:

1. A system for transmitting initialization information between fixed installations and trains, wherein the system comprises:

an initialization loop physically constituted in the same way as and located apart from a speed monitoring loop;

a speed monitoring coil attached to a train which is used for receiving both initialization messages and speed monitoring messages;

at least one source of speed monitoring messages connected to said speed monitoring loop and providing to it a speed monitoring message in the form of a modulated speed monitoring carrier wave having a speed monitoring amplitude level;

a source of initialization messages connected to the initialization loop and providing to it an initialization message in the form of an initialization carrier wave having an initialization carrier frequency modulated by an initialization signal through frequency shift keying, with an amplitude level of said initialization carrier wave being considerably higher than an amplitude level of said speed monitoring carrier wave; and circuits for recognizing initialization information, said circuits being connected to the speed monitoring coil and comprising a carrier level detection stage enabling either an initialization message receiving means or a speed monitoring message receiving means in accordance with an amplitude level at an output of said speed monitoring coil.

2. A system according to claim 1, for transmitting initialization information, including a switching device comprising, downstream from the speed-monitoring coil, at least one linear amplifier and a detection circuit for detecting an amplitude level of a carrier wave output from said linear amplifier, the detection circuit feeding a threshold circuit containing a predetermined threshold value and providing a changeover signal when the amplitude level of the carrier wave output from said linear amplifier exceeds the threshold value.

3. A system according to claim 2 for transmitting initialization information, wherein said amplifier also feeds two parallel-connected demodulators, one of the demodulators serving to detect the frequency modulation of an initialization message, and the other demodulator serving to detect the frequency modulation of a speed-monitoring message, with the output of only one of these demodulators being active at any given time depending on said changeover signal.

4. A system according to claim 3 for transmitting initialization information, wherein said switching device includes a relay controlled by said changeover signal, said relay including at least one contact for activating the output of one or the other of said two demodulators.

5. A system according to claim 3 for transmitting initialization information, wherein said switching device also controls an output of a further demodulator for detecting a frequency modulation of a second speed-monitoring message that is received via a second coil, said output of said second demodulator being controlled in such a manner as to be rendered inactive during reception of an initialization message.

6. A system according to claim 3 for transmitting initialization information, wherein the output from said circuit for detecting the level of the carrier wave is connected via a switch element controlled by said switching device to a signalling circuit for authorizing processing of the initialization message as provided at the output from said demodulator that detects the frequency modulation of an initialization message.

7. A system according to claim 3 for transmitting initialization information, wherein said demodulator for detecting the frequency modulation of an initialization message is a circuit which evaluates the duration of periods in the received modulated carrier wave and which provides an output signal at a first level when said durations are on average greater than a predetermined duration and provides an output signal at a second level when said durations are on average less than said predetermined duration.

* * * * *